US007706703B2

(12) United States Patent
Sakuwa et al.

(10) Patent No.: US 7,706,703 B2
(45) Date of Patent: Apr. 27, 2010

(54) CHANGING THE CHARGING APPLIED VOLTAGE CONTROL IN AN IMAGE FORMING APPARATUS BASED ON AN INCREASE IN THE CUMULATIVE NUMBER OF TIMES OF EXECUTION OF IMAGE FORMING

(75) Inventors: Tohru Sakuwa, Nara (JP); Kohji Shinkawa, Nara (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 553 days.

(21) Appl. No.: 11/648,780

(22) Filed: Jan. 3, 2007

(65) Prior Publication Data

US 2007/0160377 A1 Jul. 12, 2007

(30) Foreign Application Priority Data

Jan. 12, 2006 (JP) ..... 2006-005206

(51) Int. Cl.
*G03G 15/00* (2006.01)
*G03G 15/02* (2006.01)

(52) U.S. Cl. ..... 399/43; 399/44; 399/50

(58) Field of Classification Search ..... 399/43, 399/44, 50

See application file for complete search history.

(56) References Cited

U.S. PATENT DOCUMENTS 5,606,399 A 2/1997 Kikui
5,701,551 A 12/1997 Honda et al.
6,205,298 B1 3/2001 Yamamoto
6,408,145 B1 * 6/2002 Ohki ..... 399/50
6,553,192 B2 * 4/2003 Maebashi ..... 399/50
7,035,560 B2 * 4/2006 Okano et al. ..... 399/50
7,058,326 B2 * 6/2006 Toyama ..... 399/50
7,333,741 B2 * 2/2008 Tokushige ..... 399/50
7,447,452 B2 * 11/2008 Burry et al. ..... 399/50
2001/0043815 A1 11/2001 Kitajima et al.

FOREIGN PATENT DOCUMENTS

EP 0 579 499 1/1994

(Continued)

OTHER PUBLICATIONS

European Search Report.

*Primary Examiner*—William J Royer
(74) *Attorney, Agent, or Firm*—Birch, Stewart, Kolasch & Birch, LLP

(57) ABSTRACT

When image forming is performed by a photosensitive drum according to operating conditions corresponding to an image forming mode selected out of a predetermined plurality of candidates, an actual cumulative number of printed sheets Pi is corrected and recorded based on the image forming mode (monochrome mode or color mode; low-temperature and low humidity ambience mode or other ambience mode) selected at the time of each image forming (S7) and an adjustment volume (ko×Pia) of a charging applied voltage Ey is calculated and the charging applied voltage Ey is set based on a corrected cumulative number of printed sheets Pia (S5). As a result, the charging applied voltage Ey to a charging unit is changed according to a cumulative number of printed sheets and at the same time, a pace of change thereof is adjusted based on the image forming mode.

21 Claims, 4 Drawing Sheets

FOREIGN PATENT DOCUMENTS

| | | | |
|---|---|---|---|
| EP | 0 913 737 | | 5/1999 |
| JP | 8-179594 | A | 7/1996 |
| JP | 8-241018 | A | 9/1996 |
| JP | 9-190143 | A | 7/1997 |
| JP | 11-295960 | A | 10/1999 |
| JP | 2003-270910 | | 9/2003 |
| JP | 2003270910 | A1 | 9/2003 |
| JP | 2004-69804 | A | 3/2004 |
| JP | 2004-347881 | | 12/2004 |
| JP | 2004347881 | A1 | 12/2004 |

* cited by examiner

FIG.4A
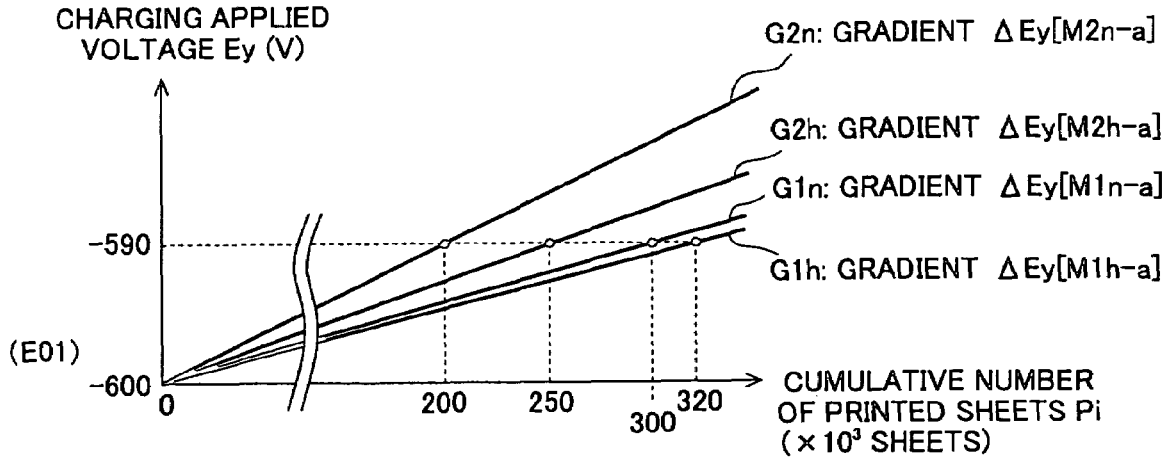
FIG.4B
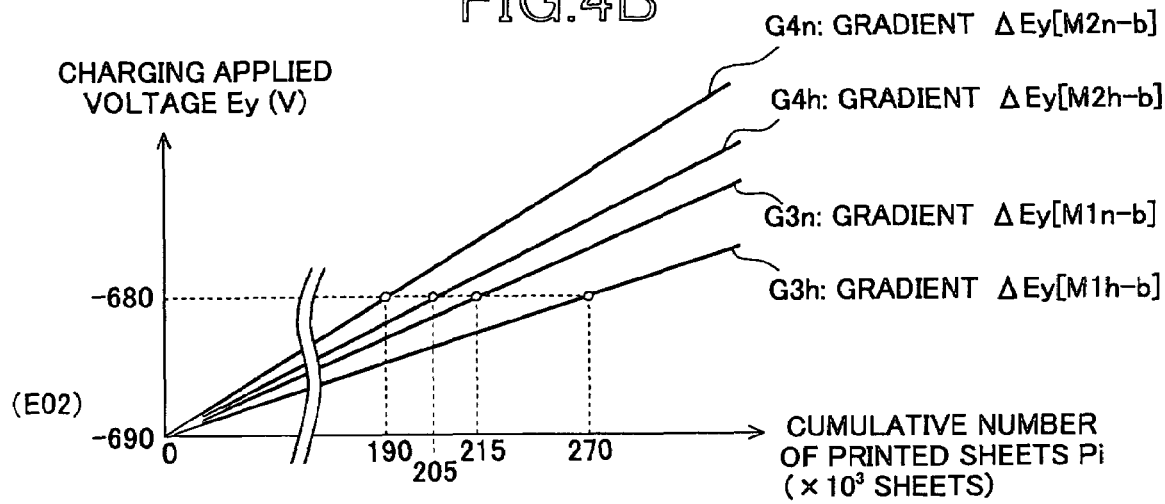
FIG.5
| | | | | | | |
|---|---|---|---|---|---|---|
| RUBBER HARDNESS (JISA) | NN (20°C60%) | 32 | 43 | 52 | 63 | 75 |
| | LL (5°C20%) | 40 | 50 | 60 | 70 | 80 |
| AMOUNT OF COAT THINNING (μm) | NN (20°C60%) | 0.8 | 1.0 | 1.2 | 1.5 | 2.2 |
| | LL (5°C20%) | 1.2 | 1.4 | 1.6 | 1.9 | 2.4 |
| | RATE OF CHANGE (LL/NN) | 1.50 | 1.40 | 1.33 | 1.27 | 1.10 |
RUBBER HARDNESS MEASURING METHOD: CONFORMING TO JIS K6253-93

CHANGING THE CHARGING APPLIED VOLTAGE CONTROL IN AN IMAGE FORMING APPARATUS BASED ON AN INCREASE IN THE CUMULATIVE NUMBER OF TIMES OF EXECUTION OF IMAGE FORMING

This non-provisional application claims priority under 35 U.S.C. §119(a) on Patent Application No. 2006-005206 filed in JAPAN on Jan. 12, 2006, the entire contents of which are hereby incorporated herein by reference.

FIELD OF THE INVENTION

The present invention relates to an image forming apparatus that forms an image by transferring an image formed on an image bearing body to a transferring material according to operating conditions corresponding to an image forming mode to be selected out of a plurality of predetermined candidates and a charging applied voltage control apparatus provided in such image forming apparatus that sets an applied voltage to a charging unit that charges the image bearing body.

BACKGROUND OF THE INVENTION

An electrophotographic image forming apparatus configured as a printer, a copying machine, a facsimile machine, a multi-functional machine, and the like writes an electrostatic latent image by irradiating a light onto a photosensitive drum (a typical example of an image bearing body) charged by a charging unit, develops the electrostatic latent image as a toner image (forming the toner image) by having a toner supplied to the photosensitive drum by a developing unit, transfers the toner image onto a predetermined recording material such as recording paper directly or on to the recording material through an intermediate transfer member such as an intermediate transfer belt, and ultimately fixes on the recording paper or the intermediate transfer member by heating the toner image with heating rollers provided in a fixing unit. In the above process, a predetermined voltage is applied to the charging unit. The applied voltage to the charging unit is hereinafter referred to as a charging applied voltage.

Some of such image forming apparatuses have an image forming mode selected and set out of a predetermined plurality of candidates and carry out an image forming process according to the operating conditions corresponding to set image forming mode. Furthermore, some apparatuses set a rotating speed of the photosensitive drum according to the selected image forming mode to ensure a constant image quality.

Some of such image forming apparatuses has an image forming mode selected and set out of a predetermined plurality of candidates and carry out an image forming processing according to the operating conditions corresponding to the set image forming mode. Furthermore, some apparatuses set a rotating speed of the photosensitive drum according to the selected image forming mode to ensure a constant image quality.

For example, an image forming apparatus having, as the image forming mode, a monochrome image forming mode of forming a monochrome image and a color image forming mode of forming a color image sets (controls) the rotating speed (circumferential velocity) of the photosensitive drum slower when the color image forming mode is selected than when the monochrome image forming mode is selected.

Another image forming apparatus having, as the image forming mode, a low-temperature and low-humidity mode to be selected when the temperature and the humidity of the ambience in which the photosensitive drum is installed are less than the predetermined level and other ambience modes (standard mode, high-temperature and high-humidity mode, etc.) to be selected in other cases sets the reference level of the charging applied voltage higher when the low-temperature and low-humidity mode is selected than when the other ambience modes are selected. The reason is as follow. Namely, since, in the low-temperature and low-humidity ambience, a phenomenon of the toner charge volume becoming greater occurs and a charge potential of the photosensitive drum becomes difficult to enhance, a sufficient image density can not be obtained by ordinary developing. Therefore, by setting the level of the charging applied voltage high, a sufficient image density can be ensured.

On the other hand, Japanese Laid-Open Patent Publication No. H08-179594 describes an image forming apparatus that counts the number of printed sheets (typed sheets) and sets the charging applied voltage at a rather high voltage initially and then gradually decreases the voltage as the number of printed sheets increases, while the number of printed sheets is still below a predetermined number of sheets, namely, until when the number of printed sheets has exceeded the predetermined number of sheets and charging capability of a charger roller has settled down to a constant level. This technology has an object of keeping a constant charged potential of a photosensitive drum irrespective of a degree of use of the charger roller and ambient conditions.

While a photosensitive layer is formed on the surface of the photosensitive drum, the photosensitive layer deteriorates due to abrasion as the number of times of use (namely, the number of times of image forming) of the photosensitive drum increases. This deterioration is hereinafter referred to as coat thinning. As the coat thinning of the photosensitive drum advances, electrostatic capacity of the photosensitive layer becomes larger and charge amount becomes greater, but if the electric field intensity remains the same, a decrease of the charge potential of the photosensitive drum adversely becomes larger due to the advance of the coat thinning. As a result, there was a problem that the volume of toner attached to the photosensitive drum decreases, that a toner image of low density is formed, and that image deficiency occurs.

A degree of coat thinning (amount of coat thinning) of the photosensitive drum is not only proportional to the number of times of use (may be the number of times of execution of image forming or the number of printed sheets) but also subject to the rotating speed (circumference velocity) of the photosensitive drum and ambient conditions such as temperature and humidity.

On the other hand, the technology described in Japanese Laid-Open Patent Publication No. H08-179594 is not intended to prevent the above-mentioned developing deficiency by appropriately setting the charging applied voltage in accordance with the degree of coat thinning of the photosensitive layer of the photosensitive drum.

In this connection, it is conceivable that, when the coat thinning is caused to the photosensitive drum, the developing deficiency can be prevented by adjusting the charging applied voltage according to the degree of the coat thinning. Then it is conceivable to apply the technology described in Japanese Laid-Open Patent Publication No. H08-179594 as measures against the developing deficiency attributable to the coat thinning of the photosensitive drum and to adjust the charging applied voltage according to the cumulative number of printed sheets. In this case, however, the following problems remain.

As described above, the degree of coat thinning of the photosensitive drum is also subject to factors other than the number of printed sheets. As a result, there remains a problem that when other factors than the number of printed sheets have changed, the technology described in Japanese Laid-Open Patent Publication No. H08-179594 can not set the appropriate charging applied voltage corresponding to the degree of coat thinning and can not secure the appropriate image density.

SUMMARY OF THE INVENTION

The object of the present invention is to provide a charging applied voltage control apparatus and an image forming apparatus equipped therewith that can set an appropriate charging applied voltage corresponding to a degree of coat thinning of a photosensitive drum and consequently can secure an appropriate image density even if the degree of the coat thinning of the photosensitive drum changes.

The present invention is configured as an image forming apparatus that executes image forming by transferring an image formed on an image bearing body (whose typical example is a photosensitive drum) onto a transferring material according to operating conditions corresponding to an image forming mode to be selected out of a predetermined plurality of candidates, or as a charging applied voltage control apparatus that is provided in such image forming apparatus and controls an applied voltage to a charging unit that charges the image bearing body, and a characteristic configuration thereof is as follows.

Namely, the configuration is characterized in that a charging applied voltage adjusting circuit unit is provided that changes the applied voltage to the charging unit according to a cumulative number of times of execution of image forming and adjusts the pace of the change (the rate of a change of the applied voltage according to an increase in the cumulative number of times of execution) based on the image forming mode.

It is conceivable that the image forming mode may include one mode or plural modes or a combination of the plural modes, out of, for example, a monochrome image forming mode of forming a monochrome image and a color image forming mode of forming a color image by rotating the image bearing body at a slower speed than when the monochrome image forming mode is selected; and a predetermined ambience mode (hereinafter, a first ambience mode) to be selected when a temperature and a humidity of the ambience in which the image bearing body is installed are less than a predetermined level and other ambience mode (hereinafter, a second ambience mode) to be selected in other cases.

The number of times of execution of image forming can ordinarily be considered as a number of printed sheets (a number of sheets of a transferring material (recording paper) on which image forming has been executed), but may also be considered as a number of times of rotation of the image bearing body.

As described above, the degree of coat thinning (amount of coat thinning) of the image bearing body is subject not only to the number of times of use thereof (which may be the number of times of execution of image forming or the number of printed sheets) but also to the rotating speed (circumferential velocity) of the image bearing body and conditions of the ambience in which the image bearing body is installed such as the temperature and humidity. In this connection, difference in the rotating speed or the ambient conditions of installation of the image bearing body can indirectly be recognized as the difference of the above-mentioned image forming modes. For this reason, according to the above-mentioned configuration of the present invention, even if there is a change in factors other than the cumulative number of times of execution of image forming that affect the degree of coat thinning of the image bearing body while the image forming apparatus is in operation, an appropriate charging applied voltage (applied voltage to the charging unit) can be set that corresponds to the degree of coat thinning of the image bearing body and, as a result, an appropriate image density can be secured notwithstanding the change of the state of coat thinning of the image bearing body.

Results of various experiments have revealed that it is preferable for securing the appropriate image density to adjust the pace of changing (or pace of modifying; hereinafter, voltage changing pace) the applied voltage to the charging unit according to an increase in the cumulative number of times of execution of image forming by the charging applied voltage adjusting circuit unit, as follows.

Namely, it is preferable to make adjustment so that the voltage changing pace for the image forming mode of the color image forming mode becomes about 1.05 times to about 1.6 times as great as the voltage changing pace for the image forming mode of the monochrome image forming mode.

It is also preferable to make adjustment so that the voltage changing pace for the image forming mode of the first ambience mode becomes about 1.1 times to about 1.5 times as great as the voltage changing pace for the image forming mode of the second ambience mode.

Conceivable specific contents of the charging applied voltage adjusting circuit unit may be the charging applied voltage adjusting circuit unit comprising, for example, an execution times calculating and recording unit of calculating and recording in a memory unit a corrected cumulative number of times of execution of image forming by correcting the cumulative number of times (actual number of times) of execution of image forming based on the image forming mode selected at each image forming and an applied voltage adjustment volume calculating circuit of calculating the volume of adjustment of the applied voltage to the charging unit based on thus recorded corrected cumulative number of times of execution of image forming.

More specifically, it is conceivable, for example, that the execution times calculating and recording unit calculates the corrected cumulative number of times of execution of image forming by correcting the actual number of times of execution of image forming according to the image forming mode selected at each image forming, when the image forming has been executed and by adding up the corrected number of times of execution.

Thus the calculated corrected cumulative number of times of execution of image forming is the number of times reflecting the results of at which mode of image forming and how many times the image forming was executed in the past. Therefore, if the charging applied voltage is changed according to the corrected cumulative number of times of execution of image forming, then the voltage changing pace according to the actual number of times of execution is adjusted based on the image forming mode.

With such configuration, it is not necessary to memorize the actual cumulative number of times of execution of image forming for each of the image forming modes. Namely, an appropriate charging applied voltage corresponding to the degree of coat thinning of the image bearing body can be set by a simple process of always memorizing only the latest corrected cumulative number of times of execution of the image forming.

BRIEF DESCRIPTION OF THE DRAWINGS

FIGS. 4A and 4B are graphs of voltage changing paces when a charging applied voltage is changed according to a cumulative number of printed sheets to obtain a appropriate image quality in the image forming apparatus A.

FIG. 5 is a diagram of a relationship between ambient conditions in the image forming apparatus A and an amount of coat thinning of a photosensitive drum surface and hardness of a cleaning blade.

PREFERRED EMBODIMENTS OF THE INVENTION

For better understanding of the present invention, description will now be made of an embodiment of the present invention, with reference to the accompanying drawings. The following embodiment is an example of an embodiment of the present invention and is not intended to limit the technological scope of the present invention.

Figure 1:
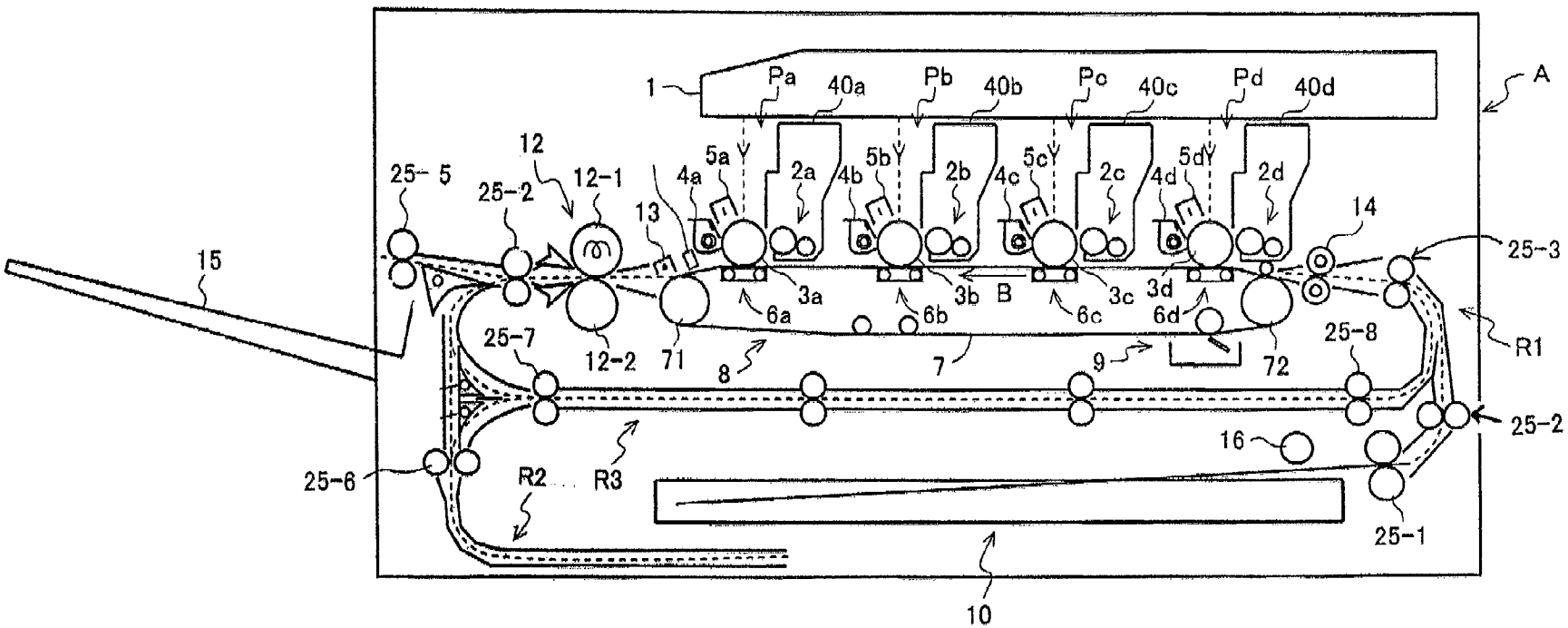
FIG. 1 is a diagram of a schematic configuration of an image forming apparatus A according to an embodiment of the present invention.
Figure 2:
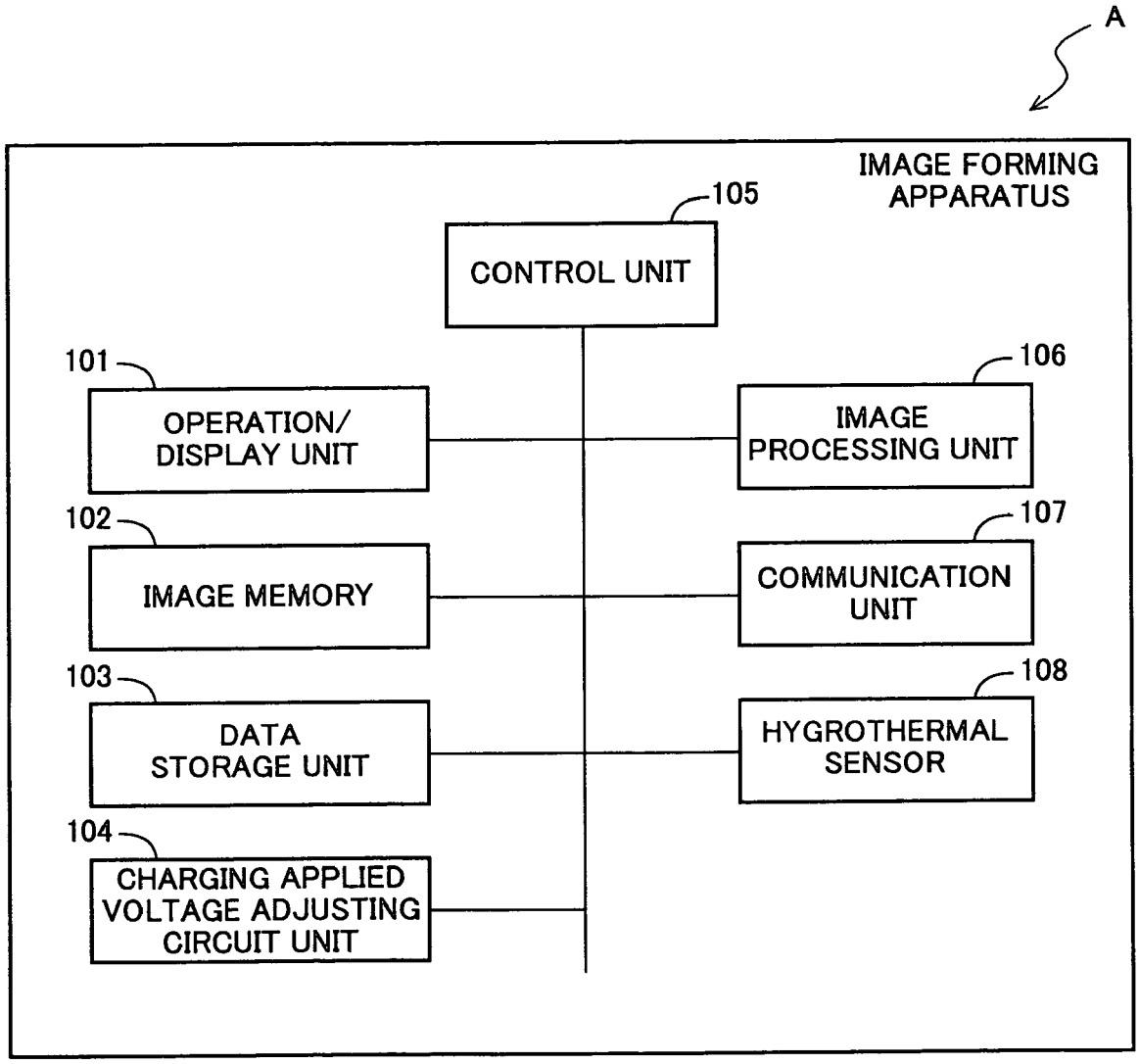
FIG. 2 is a block diagram of a schematic configuration associated with a control unit of the image forming apparatus A.
Figure 3:
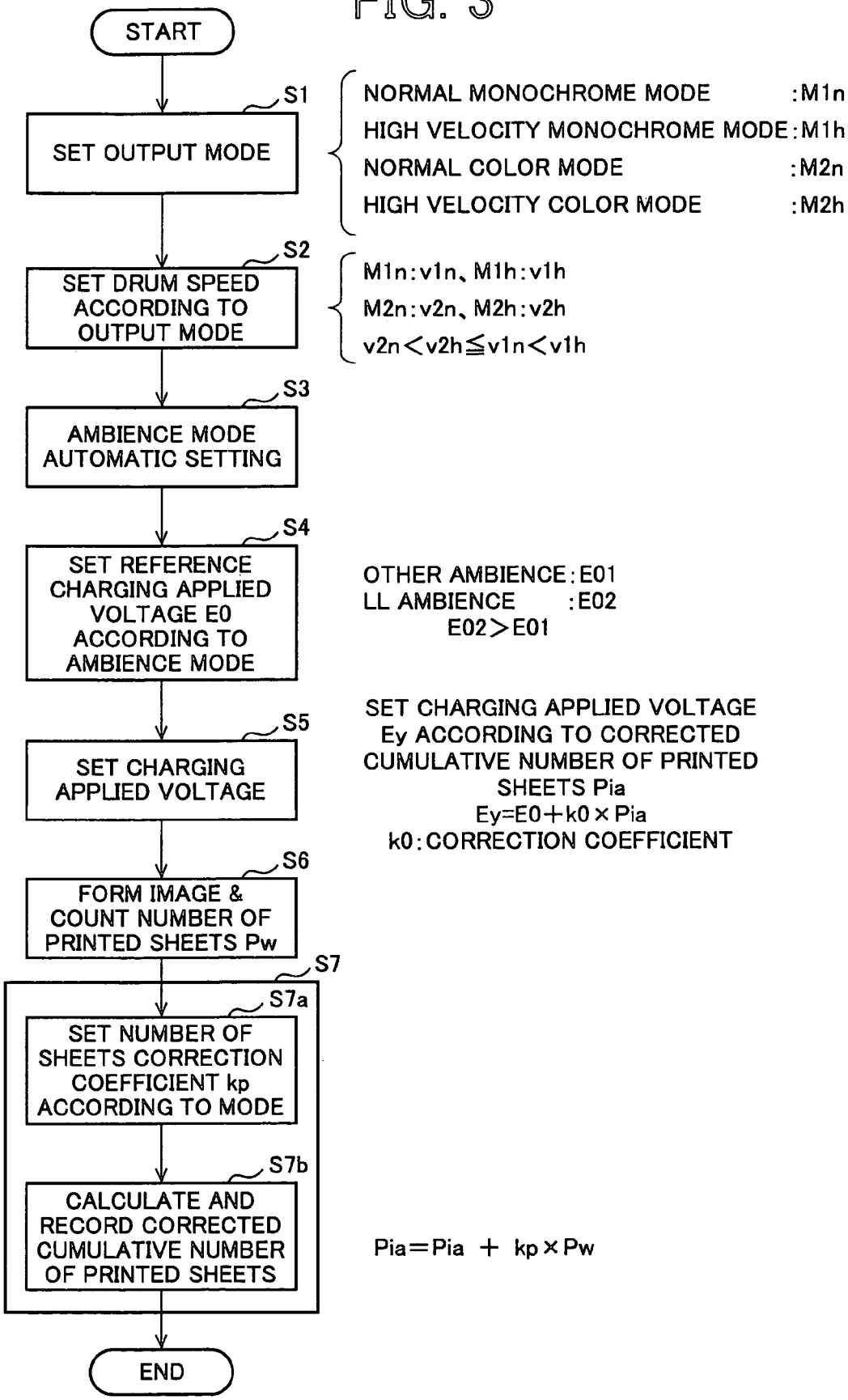
FIG. 3 is a flow chart of a procedure of charging applied voltage control in the image forming apparatus A.

FIG. 1 is a diagram of a schematic configuration of an image forming apparatus A according to the embodiment of the present invention, FIG. 2 is a block diagram of a schematic configuration associated with a control unit of the image forming apparatus A, FIG. 3 is a flow chart of a procedure of charging applied voltage control in the image forming apparatus A, FIGS. 4A and 4B are graphs of voltage changing paces when a charging applied voltage is changed according to a cumulative number of printed sheets to obtain appropriate image quality in the image forming apparatus A, and FIG. 5 is a diagram of a relationship between ambient conditions in the image forming apparatus A and a coat thinning amount of a photosensitive drum surface and hardness of a cleaning blade.

Firstly, description will be made of the configuration of the image forming apparatus A according to the embodiment of the present invention, with reference to the schematic cross-sectional view shown in FIG. 1.

The image forming apparatus A is an image forming apparatus (color printer, color copying machine, and the like) that forms a monochrome or color image on recording paper (one example of a transferring material) according to contents of a predetermined print job when the print job is input from an external apparatus such as a personal computer. In this embodiment, the image forming apparatus A will be described as a tandem-system color printer that executes the image forming using 4 color toners of magenta (M), cyan (C), and yellow (Y), which are three primary colors of subtractive color mixing obtained by color separation of a color image, and black (K) in addition.

As shown in FIG. 1, the image forming apparatus A comprises an exposure unit 1, developing units 2*a* to 2*d* (collectively, developing unit 2), photosensitive drums 3*a* to 3*d* (collectively, photosensitive drum 3), cleaner units 4*a* to 4*d* (collectively, cleaner unit 4), charging units 5*a* to 5*d* (collectively, charging unit 5), intermediate transfer rollers 6*a* to 6*d* (collectively, intermediate transfer roller 6), an intermediate transfer belt unit 8, a belt cleaner 9, first to third transport paths R1 to R3, a paper feed tray 10, an electricity eliminator 13, a fixing unit 12 (12-1,12-2), a register roller 14, a paper eject tray 15, a pick-up roller 16, and transport rollers 25-1 to 25-8 (collectively, transport roller 25).

The developing unit 2, the photosensitive drum 3, the cleaner unit 4, the charging unit 5, and the intermediate transfer roller 6 are provided four pieces each, one piece each for each of color components (M, C, Y, and K), and toner cartridges 40*a* to 40*d* (collectively, toner cartridge 40) containing toners corresponding to color components of black, cyan, magenta, and yellow, respectively, are mounted, and all of these make up four image forming units Pa to Pd (collectively, image forming unit P). Each image forming unit P is arranged sequentially in a line from an upstream side to a downstream side in a the transport direction B (indicated by an arrow B) of an intermediate transfer belt 7 and develops a visible image of toners of black, cyan, magenta, and yellow on the intermediate transfer belt 7.

The charging unit 5 is a unit that uniformly charges the surface (photosensitive layer) of the photosensitive drum 3 to a predetermined potential. The voltage necessary for charging the photosensitive drum 3 is applied to the charging unit 5. The applied voltage to the charging unit 5 is hereinafter referred to as charging applied voltage. The level of the charging applied voltage is so configured as to be controllable by a charging applied voltage adjusting circuit unit to be described later.

The exposure unit 1 is a unit that, by exposing the charged photosensitive drum 3 according to the contents of a print job (image data) transmitted from an external computer forms an electrostatic latent image according to the print job on the surface of the photosensitive drum 3. The exposure unit 1 can be configured by a laser scanning unit (LSU) equipped with a laser illumination unit and a reflecting mirror, or an EL or LED writing head with light emitting devices arranged in an array.

Each developing unit 2 holds black, cyan, magenta, or yellow toner supplied by corresponding toner cartridge 40 respectively and visualizes (develops) each color latent image formed by corresponding photosensitive drum 3 as a toner image. The cleaner unit 4 removes and recovers the toner remaining on the surface of the photosensitive drum 3 after the development and image transfer by pressing a cleaning blade made of rubber against the surface of the photosensitive drum 3.

The intermediate transfer belt unit 8 comprises an intermediate transfer belt drive roller 71, an intermediate transfer belt follower roller 72, and the intermediate transfer belt 7 stretched over between the rollers 71 and 72 and forming a looped moving path. With the intermediate transfer belt drive roller 71 being driven to rotate, the intermediate transfer belt 7 is driven to rotate in the direction of the arrow B. The outer circumferential face of the intermediate transfer belt 7 is opposed to each of the photosensitive drum 3, and each of the intermediate transfer roller 6 is arranged in a position opposed to each of the photosensitive drum 3 across the intermediate transfer belt 7. The intermediate transfer belt 7 is formed in an endless state using, for example, a film of thickness on the order of 100 μm to 150 μm.

Meanwhile, the paper feed tray 10 contains the recording paper to be used for image forming, and the paper eject tray 15 provided in the upper part of the image forming apparatus A is a tray to which the printed (image-formed) recording paper is ejected.

The recording paper contained in the paper feed tray 10 is transported by the transport roller 25 for accelerating and assisting the transport thereof, the pick-up roller 16, the register roller 14, the intermediate transfer belt unit 8, and the fixing unit 12, through the first transport path R1 and is ejected to the paper eject tray 15. The recording paper being transported by the intermediate transfer belt 7, electrostatically attracted to the intermediate transfer belt 7, is separated from the intermediate transfer belt 7 by the electricity eliminator 13 to which AC current is applied and is led to the fixing unit 12.

The intermediate transfer roller 6 is a roller for transferring the toner image on the Photosensitive drum 3 to the recording paper when the recording paper is being transported by the intermediate transfer belt 7 or to the intermediate transfer belt 7 when the recording paper is not being transported, and a high-voltage transfer bias (high voltage of a polarity opposite (+) to the charge polarity (−) of toner) is applied to the intermediate transfer roller 6. As a result, toner images of respective colors formed on respective photosensitive drums 3 are sequentially transferred, one over the other, to the recording paper on the intermediate transfer belt 7 or the outer circumferential face of the intermediate transfer belt 7, forming an image corresponding to the print job input from the outside.

The fixing unit 12 is a unit for thermally fixing the toner image on the recording paper by heating and pressing, and comprises a heating roller 12-1 and a pressure roller 12-2. The heating roller 12-1 is controlled to remain at a predetermined fixing temperature by a control unit to be described later, based on a signal from a temperature detector not shown.

Description will now be made of the schematic configuration associated with a control unit of the image forming apparatus A, with reference to the block diagram shown in FIG. 2.

As shown in FIG. 2, the image forming apparatus A comprises not only constituent elements shown in FIG. 1, but also an operation/display unit 101, an image memory 102, a data storage unit 103, a charging applied voltage adjusting circuit unit 104, a control unit 105, an image processing unit 106, a communication unit 107, and a hygrothermal sensor 108.

The operation/display unit 101 is an input-output interface (man-machine interface) for operation, equipped with both an operation input unit and a display unit, and made up of, for example, a liquid crystal touch panel.

The image memory 102 is a memory for temporary storage of image data at the time of processing of the image data based on a print job.

The data storage unit 103 is a re-writable mass-storage nonvolatile memory such as a hard disk for storing various data.

The charging applied voltage adjusting circuit unit 104 is a circuit for applying (outputting) the charging applied voltage to the charging unit 5 and has a function of adjusting the level of the applied voltage in accordance with the instruction from the control unit 105.

The control unit 105 comprises a CPU and its peripheral devices (ROM, RAM, and the like) and controls the constituent elements of the image forming apparatus A by executing processing according to a predetermined program stored in the ROM.

And, the image processing unit 106 comprises a dedicated signal processing circuit or a DSP (Digital Signal Processor) and performs various image processing of original image data and performs processing of converting a print job to image data used for the image forming.

The communication unit 107 is a communication interface for communicating with external host apparatus (personal computer) through a network. The print job from the host apparatus is received through this communication unit 107.

The hygrothermal sensor 108 is a sensor for detecting the temperature and the humidity of the ambience in which the image forming apparatus A is installed (namely the ambience in which the photosensitive drum 3 is installed).

The image forming apparatus A has an image forming mode selected and set out of a predetermined plurality of candidates and executes image forming processing according to operating conditions corresponding to the selected image forming mode.

While details of the image forming mode will be described later, the image forming mode in the present embodiment comprises an output mode indicating which of monochrome or color image forming is to be executed and an ambience mode classified according to the level of the temperature and the humidity of the ambience in which the photosensitive drum 3 is installed.

The data storage unit 103, the charging applied voltage adjusting circuit unit 104 and the control unit 105 constitute an example of the charging applied voltage control apparatus that controls the applied voltage to the charging unit 5 that charges the photosensitive drum 3 (an example of the image bearing body).

Description will now be made of a procedure of the charging applied voltage control in the image forming apparatus A, with reference to a flow chart shown in FIG. 3. The processing shown in FIG. 3 is performed by the execution of a predetermined control program by the control unit 105 and is started when a print job (print request) is received from an external host apparatus such as a personal computer, through the communication unit 107. S1, S2, . . . S7 described below, indicate identification numerals for processing procedure (step).

<Step S1>

Firstly, the control unit 105 refers to contents of the print job received from the host apparatus, judges how the output mode of image is designated and sets the output mode (an example of image forming mode) according to the designation (S1). As a result, the designated output mode is stored in the RAM of the control unit 105.

In the present embodiment, candidates of the output mode are a normal monochrome mode M1*n* of forming a monochrome image at a predetermined normal velocity v1*n*, a high velocity monochrome mode M1*h* of forming a monochrome image at a higher velocity v1*h* than the normal velocity v1*n*, a normal color mode M2*n* of forming a color image at a predetermined normal velocity v2*n*, and a high velocity color mode M2*h* of forming a color image at a higher velocity v2*h* than the normal velocity v2*n*.

<Step S2>

Then, the control unit 105 sets the rotating speed of the photosensitive drum 3 at the time of image forming according to the output mode set at step S1(S2). The rotating speed of the photosensitive drum 3 is hereinafter referred to as a drum speed. A drum speed for each of the output mode settings is stored beforehand in the ROM of the control unit 105 and the drum speed is set based on such stored information. Incidentally, the drum speed may be replaced by a circumferential velocity of the photosensitive drum 3.

The magnitude relation of the drum speeds corresponding to each output modes is "$v2n<v2h\leqq v1n<v1h$". As seen above, the rotating speed of the photosensitive drum 3 when the color mode M2*n* or M2*h* is selected is set to a speed lower than the rotating speed of the photosensitive drum 3 when the monochrome mode M2*n* or M1*h* is selected, to secure a constant image quality. The color modes M2*n* and M2*h* in which the image forming is made by overlapping three or four color toners need a precision control so that there will be no out-of-registration problem among images of respective colors. For this reason, when the color mode M2*n* or M2*h* is selected, the drum speed is set to a slower speed than when the monochrome mode M1*n* or M1*h* is selected, to ensure positional accuracy of the apparatus affecting the position of each color image.

<Step S3>

The temperature and the humidity detected by the hygrothermal sensor 108 are acquired by the control unit 105 and, based on the results of detection, the ambience mode is automatically set (S3). As described above, the hygrothermal sensor 108 is a sensor to detect the temperature and the humidity of the ambience in which the image forming apparatus A including the photosensitive drum 3 is installed.

In the present embodiment, based on predetermined thresholds, the detected temperature is classified as three steps, high temperature, normal temperature, and low temperature, and likewise, the detected humidity is classified as three steps, high humidity, normal humidity, and low humidity, and to which the present ambience mode corresponds is determined, out of nine ambience mode candidates obtained by combining these classified steps of the detected temperature and the detected humidity.

For example, the temperature is classified as low temperature at below 5° C., as high temperature at 30° C. or over, and as normal temperature in other cases. Likewise, the humidity is classified as low humidity at below 20%, as high humidity at 80% or over, and as normal humidity in other cases.

The ambience mode at low temperature and low humidity is hereinafter referred to as "LL ambience mode" (an example of the first ambience mode) and the ambience mode at other cases is hereinafter referred to as "other ambience mode" (an example of the second ambience mode).

<Step S4>

Then, a reference value of the charging applied voltage (hereinafter, reference applied voltage E0) is set by the control unit 105 according to the ambience mode set at step S3 (S4). The charging applied voltage to the charging unit 5 is set by correcting the reference applied voltage E0. The drum speed for each of ambience mode settings is stored in advance in ROM of the control unit 105 and the reference applied voltage E0 is set based on such stored information.

If the reference applied voltage when the other ambience mode is selected is given as E01 and the reference applied voltage when the LL ambience mode is selected is given as E02, then the magnitude relation of the reference applied voltages E01 and E02 is "E02>E01". As seen above, by setting the charging applied voltage to a high level in the ambience of low temperature and low humidity, the volume of toner attached to the photosensitive drum 3 is prevented from decreasing and sufficient image density is ensured, even if the charge volume of toner becomes great due to the ambience of the low temperature and the low humidity.

<Step S5>

Then, the control unit 105 sets the charging applied voltage Ey that is output (instructed) to the charging applied voltage adjusting circuit unit 104 and is applied to the charging unit 5 at the time of execution of image forming (S5).

At this step S5, while the reference applied voltage E0 is used as a basis, the control unit 105 calculates an adjustment volume of the charging applied voltage Ey, based on a corrected cumulative number of printed sheets Pia to be recorded at step S7 described later and sets the charging applied voltage Ey, based on such adjustment volume. For example, the charging applied voltage Ey is set by applying the following equation (1):

$$Ey=E0+ko\times Pia \quad (1)$$

where ko is a predetermined correction coefficient (0<ko). The value calculated by the (ko×Pia) portion in the equation (1) represents the adjustment volume of the charging applied voltage Ey calculated based on a corrected cumulative number of printed sheets Pia. Incidentally, normally, the charging applied voltage Ey is set within a range below a predetermined upper limit value from the reference applied voltage E0, irrespective of the value calculated according to the above equation (1).

At step S5, with the charging applied voltage Ey set by the control unit 105 according to the calculating equation such as the equation (1), the charging applied voltage Ey varies according to the cumulative number of printed sheets (cumulative number of times of execution of image forming) and at the same time, the pace of the change thereof is adjusted according to the image forming mode selected at the time of image forming (an example of charging applied voltage adjusting). Details of the adjustment of the charging applied voltage Ey will be described later.

<Step S6>

By controlling the image forming unit P (Pa to Pd) by the control unit 105, the processing of image forming to the recording paper is executed according to contents of a print job received from the host apparatus (S6). In this execution, the control unit 105 counts the number of printed sheets Pw (number of sheets of recording paper on which image forming is executed) based on the print job. In executing the image forming, the charging applied voltage Ey set at step S5 is applied to the charging unit 5. Here, the level of charging applied voltage Ey is adjusted by the charging applied voltage adjusting circuit unit 104 as instructed by the control unit 105.

<Step S7>

Then, the control unit 105 executes the processing of calculating the corrected cumulative number of printed sheets Pia that is a parameter used for calculating a voltage value of the charging applied voltage E0 and the processing of recording thus calculated value in the data storage unit 103 (S7; an example of processing of the execution times calculating and recording unit) and then the sequence of processing is finished.

The corrected cumulative number of printed sheets Pia (an example of corrected cumulative number of times of image forming) is the cumulative number of printed sheets calculated by correcting the cumulative number of printed sheets obtained by adding up the actual number of sheets printed in the past (an example of cumulative number of times of execution of image forming) based on the image forming mode (output mode and ambience mode) selected at the time of each image forming (printing).

Description will then be made of contents of calculating processing of the corrected cumulative number of printed sheets Pia.

<Step S7*a*>

In Step S7, firstly, the control unit 105 sets the correction coefficient used for calculation of the corrected cumulative number of printed sheets Pia (hereinafter, number of sheets correction coefficient kp) according to the image forming mode (output mode and ambience mode) selected at the time of image forming at Step S6 (S7*a*). The number of sheets correction coefficient (coefficient value) to be set for each of the image forming modes is stored in advance in the data storage unit 103 and the control unit 105 refers to the stored information. Specific example of number of sheets correction coefficient kp will be described later.

<Step S7*b*>

Next, the actual number of printed sheets Pw counted at the time of image forming at Step S6 (number of printed sheets by a sequence of print processing based on a print job (an example of actual number of times of execution of image forming)) is corrected by the control unit 105, using the number of sheets correction coefficient kp, and by adding up the corrected number of printed sheets, the corrected cumulative number of printed sheets Pia is calculated and at the same time, the calculated value Pia is stored in the data storage unit 103 (S7*b*). For example, the number of printed sheets obtained by multiplying the actual number of printed sheets Pw by the number of sheets correction coefficient kp is taken as the corrected number of printed sheets (number of sheets to be added up). Specifically, the corrected cumulative number of printed sheets Pia is calculated by applying the following equation (2):

$$Pia=Pia+kp\times Pw \quad (2)$$

where since the number of sheets correction coefficient kp is set according to the image forming mode selected in image forming processing, the corrected number of printed sheets to be added up (=kp×Pw) is the actual number of printed sheets Pw corrected according to the image forming mode selected at the time of image forming.

The corrected cumulative number of printed sheets Pia is reset according to a predetermined reset operation through the operation/display unit 101 when the photosensitive drum 3 is exchanged for maintenance.

FIGS. 4A and 4B are graphs of the voltage changing pace when the charging applied voltage Ey is changed according to the actual cumulative number of printed sheets Pi to obtain appropriate image quality (appropriate image density) in the image forming apparatus A.

FIGS. 4A and 4B show the results when the ambience mode is the other ambience mode and the LL ambience mode (low temperature and low humidity), respectively.

Four graph lines in FIG. 4A represent results under different conditions of the output mode; graph G1*n* represents results at the normal monochrome mode M1*n*, graph G1*h* represents results at the high velocity monochrome mode M1*h*, graph G2*n* represents results at the normal color mode M2*n*, and graph G2*h* represents results at the high velocity color mode M2*h*.

Four graph lines in FIG. 4B also represent results under different conditions of the output mode; graph G3*n* represents results at the normal monochrome mode M1*n*, graph G3*h* represents results at the high velocity monochrome mode M1*h*, graph G4*n* represents results at the normal color mode M2*n*, and graph line G4*h* represents results at the high velocity color mode M2*h*.

The photosensitive drum 3 is a multi-layer organic photoconductor and the surface layer is composed of a polycarbonate resin and a charge transport material. As to the circumferential velocity (velocity of circumferential face) of the photosensitive drum 3, the circumferential velocity vs1*n* at the normal monochrome mode M1*n* is 350 (mm/sec.), the circumferential velocity vs1*h* at the high velocity monochrome mode M2*h* is 450 (mm/sec.), the circumferential velocity vs2*n* at the normal color mode M2*n* is 272 (mm/sec.), and the circumferential velocity vs2*h* at the high velocity color mode M2*h* is 350 (mm/sec.). And the material of the cleaning blade in the cleaner unit 4 is urethane rubber and the linear pressure with which the cleaning blade is pressed against the surface of the photosensitive drum 3 is 12 g/cm.

Then, the reference applied voltage E0 (=E01) at the other ambience mode (FIG. 4A) is −600(V) and the reference applied voltage E0 (=E02) at the LL ambience mode (FIG. 4B) is −690(V).

The size of the recording paper used for image forming is uniform for all conditions.

FIGS. 4A and 4B indicate that, in case of no change of the image forming mode, at least within several hundreds of thousand sheets in the cumulative number of printed sheets Pi, if the charging applied voltage Ey is changed (modified) at a constant pace according to an increase in the cumulative number of printed sheets Pi (actual cumulative number of printed sheets), constant image density can be obtained.

However, an appropriate pace at which the charging applied voltage Ey is to be changed (hereinafter, voltage changing pace ΔEy(V/sheet)) differs for every image forming mode. Namely, from the contents of FIG. 4A, when the ambience mode is the other ambience mode, the voltage changing pace ΔEy[M1*n*−a] at the normal monochrome mode M1*n* is $(10/300\times10^{-3})$, the voltage changing pace ΔEy[M1*h*−a] at the high velocity monochrome mode M1*h* is $(10/320\times10^{-3})$, the voltage changing pace ΔEy[M2*n*−a] at the normal color mode M2*n* is $(10/200\times10^{-3})$, and the voltage changing pace ΔEy[M2*h*−a] at the high velocity color mode M2*h* is $(10/250\times10^{-3})$.

And, from the contents of FIG. 4B, when the ambience mode is the LL ambience mode, the voltage changing pace ΔEy[M1*n*−b] at the normal monochrome mode M1*n* is $(10/215\times10^{-3})$, the voltage changing pace ΔEy[M1*h*−b] at the high velocity monochrome mode M1*h* is $(10/270\times10^{-3})$, the voltage changing pace ΔEy[M2*n*−b] at the normal color mode M2*n* is $(10/190\times10^{-3})$, and the voltage changing pace ΔEy[M2*h*−b] at the high velocity color mode M2*h* is $(10/205\times10^{-3})$.

Therefore, in the situation where the cumulative number of printed sheets increases, to maintain appropriate image density even when the image forming mode is changed, it is appropriate to adjust the voltage changing pace ΔEy (the pace at which the charging applied voltage Ey is changed according to an increase in the cumulative number of printed sheets Pi) according to the image forming mode actually selected.

For example, on the basis of the case when the ambience mode is the other ambience mode and when the output mode is the normal monochrome mode M1*n* (hereinafter, standard mode), the following can be said from the test results shown in FIGS. 4A and 4B:

Here, for convenience sake, it is assumed that the correction coefficient ko in the equation (1) for obtaining charging applied voltage Ey is set at a value equal to the ideal voltage changing pace ΔEy[M1*n*−a] $(=10/300\times10^{-3})$ at this standard mode.

<Case of Other Ambience Mode>

The following can be said when the ambience mode is the other ambience mode.

Namely, when the output mode is the normal monochrome mode M1*n* (the standard mode), it is not necessary to correct the voltage changing pace ΔEy with reference to the standard mode. Therefore, when the charging applied voltage Ey is set according to the equation (1) at step S5, it is appropriate to set the number of sheets correction coefficient kp at 1.0 at step S7*a*.

On the other hand, when the output mode is the high velocity monochrome mode M1*h*, it is necessary to make the voltage changing pace ΔEy (ΔEy[M1*h*−a]/ΔEy[M1*n*−a] ≈0.94) times as great as the voltage changing pace ΔEy in the case of the standard mode. Therefore, when the charging applied voltage Ey is set according to the equation (1), it is appropriate to set the number of sheets correction coefficient Kp at about 0.94 at step S7*a*.

Likewise, when the output mode is the normal color mode M2*n*, it is necessary to make the voltage changing pace ΔEy (ΔEy[M2*n*−a]/ΔEy[M1*n*−a]≈1.5) times as great as the voltage changing pace ΔEy in the case of the standard mode. Therefore, when the charging applied voltage Ey is set according to the equation (1), it is appropriate to set the number of sheets correction coefficient Kp at about 1.5 at step S7*a*.

Likewise, when the output mode is the high velocity color mode M2*h*, it is necessary to make the voltage changing pace ΔEy (ΔEy[M2*h*−a]/ΔEy[M1*n*−a]≈1.2) times as great as the voltage changing pace ΔEy in the case of the standard mode. Therefore, when the charging applied voltage Ey is set according to the equation (1), it is appropriate to set the number of sheets correction coefficient Kp at about 1.2 at step S7*a*.

<Case of LL Ambience Mode>

The following can be said when the ambience mode is the LL ambience mode.

Namely, when the output mode is the normal monochrome mode M1*n* (the standard mode), it is necessary to make the voltage changing pace ΔEy (ΔEy[M1*n*−b]/ΔEy[M1*n*−a] ≈1.4) times as great as the voltage changing pace ΔEy in the case of the standard mode. Therefore, when the charging applied voltage Ey is set according to the equation (1), it is appropriate to set the number of sheets correction coefficient kp at about 1.4 at step S7*a*.

Likewise, when the output mode is the high velocity monochrome mode M1*h*, it is necessary to make the voltage changing pace ΔEy (ΔEy[M1*h*−b]/ΔEy[M1*n*−a]≈1.1) times as great as the voltage changing pace ΔEy in the case of the standard mode. Therefore, when the charging applied voltage Ey is set according to the equation (1), it is appropriate to set the number of sheets correction coefficient Kp at about 1.1 at step S7*a*.

Likewise, when the output mode is the normal color mode M2*n*, it is necessary to make the voltage changing pace ΔEy (ΔEy[M2*n*−b]/ΔEy[M1*n*−a]≈1.6) times as great as the voltage changing pace ΔEy in the case of the standard mode. Therefore, when the charging applied voltage Ey is set according to the equation (1), it is appropriate to set the number of sheets correction coefficient Kp at about 1.6 at step S7*a*.

Likewise, when the output mode is the high velocity color mode M2*h*, it is necessary to make the voltage changing pace ΔEy (ΔEy[M2*h*−b]/ΔEy[M1*n*−a]≈1.4) times as great as the voltage changing pace ΔEy in the case of the standard mode. Therefore, when the charging applied voltage Ey is set according to the equation (1), it is appropriate to set the number of sheets correction coefficient Kp at about 1.4 at step S7*a*.

Also, the following can be said as to FIGS. 4A and 4B.

Namely, when the ambience mode is the other ambience mode, the ratio of the voltage changing pace ΔEy when the output mode is the color mode M2*n* or M2*h* to the voltage changing pace ΔEy when the output mode is the monochrome mode M1*n* or M1*h* is about 1.2 times (≈ΔEy[M2*h*−a]/ΔEy [M1*n*−a]) at the minimum and about 1.6 times (≈ΔEy[M2*n*−a]/ΔEy[M1*h*−a]) at the maximum.

Therefore, when the ambience mode is the other ambience mode, it is preferable to make adjustment so that the voltage changing pace ΔEy when the output mode is the color mode (M2*n* or M2*h*) will be within the range of about 1.2 times to about 1.6 times as great as the voltage changing pace ΔEy when the output mode is the monochrome mode (M1*n* or M1*h*). The range of adjustment of the voltage changing pace ΔEy as used herein can be replaced in the present embodiment by the range of adjustment of the number of sheets correction coefficient kp. Same thing applies to the adjustment range of the voltage changing pace ΔEy described hereinafter.

Likewise, when the ambience mode is the LL ambience mode, the ratio of the voltage changing pace ΔEy when the output mode is the color mode M2*n* or M2*h* to the voltage changing pace ΔEy when the output mode is the monochrome mode M1*n* or M1*h* is about 1.05 times (≈ΔEy[M2*h*−b]/ΔEy [M1*n*−b]) at the minimum and about 1.42 times (≈ΔEy[M2*n*−b]/ΔEy[M1*h*−b]) at the maximum.

Therefore, when the ambience mode is the LL ambience mode, it is preferable to make adjustment so that the voltage changing pace ΔEy when the output mode is the color mode (M2*n* or M2*h*) will be within the range of about 1.05 times to about 1.42 times as great as the voltage changing pace ΔEy when the output mode is the monochrome mode (M1*n* or M1*h*).

Consequently, irrespective of the state of the ambience mode, it is preferable to make adjustment so that the voltage changing pace ΔEy when the output mode is the color mode (M2*n* or M2*h*) will be within the range of about 1.05 times to about 1.60 times as great as the voltage changing pace ΔEy when the output mode is the monochrome mode (M1*n* or M1*h*).

Then, when the output mode is the monochrome mode (M1*n* or M1*h*), the ratio of the voltage changing pace ΔEy when the ambience mode is the LL ambience mode to the voltage changing pace ΔEy when the ambience mode is the other ambience mode (an example of the second ambience mode) is about 1.1 times (≈ΔEy[M1*h*−b]/ΔEy[M1*n*−a]) at the minimum and about 1.5 times (≈ΔEy[M1*n*−a]/ΔEy[M1*h*−a]) at the maximum.

Therefore, it is preferable to make adjustment so that the voltage changing pace ΔEy when the output mode is the monochrome mode (M1*n* or M1*h*) and when the ambience mode is the LL ambience mode (the first ambience mode) will be within the range of about 1.1 times to about 1.5 times as great as the voltage changing pace ΔEy when the output mode is the monochrome mode (M1*n* or M1*h*) and when the ambience mode is the other ambience mode (the second ambience mode).

Likewise, when the output mode is the color mode (M2*n* or M2*h*), the ratio of the voltage changing pace ΔEy when the ambience mode is the LL ambience mode to the voltage changing pace ΔEy when the ambience mode is the other ambience mode (an example of the second ambience mode) is about 0.98 times (≈ΔEy[M2*h*−b]/ΔEy[M2*n*−a]) at the minimum and about 1.32 times (≈ΔEy[M2*n*−b]/ΔEy[M2*h*−a]) at the maximum.

Therefore, it is preferable to make adjustment so that the voltage changing pace ΔEy when the output mode is the color mode (M2*n* or M2*h*) and when the ambience mode is the LL ambience mode (the first ambience mode) will be within the range of about 0.98 times to about 1.32 times as great as the voltage changing pace ΔEy when the output mode is the color mode (M2*n* or M2*h*) and when the ambience mode is the other ambience mode (the second ambience mode).

As seen above, the image forming apparatus A controls so that the charging applied voltage Ey (applied voltage to the charging unit 5) is changed according to the cumulative number of printed sheets (an example of the number of times of execution of image forming) and at the same time, the changing pace thereof ΔEy (the degree of changing of the applied voltage according to an increase in the cumulative number of times of execution) is adjusted according to the image forming mode (output mode and ambience mode). As a result, even if there is a change in factors other than the number of printed sheets that affect the degree of coat thinning of the photosensitive drum 3 while the image forming apparatus A is in operation, an appropriate charging applied voltage Ey can be set that corresponds to the degree of coat thinning of the photosensitive drum 3. Consequently, appropriate image density can be ensured notwithstanding the change of the state of coat thinning of the photosensitive drum 3.

On the other hand, FIG. 5 is a diagram in tabular form of a relationship between the ambient conditions in the image forming apparatus A and the coat thinning amount of surface of the photosensitive drum 3 and hardness (indicated as rubber hardness in the diagram) of a cleaning blade (made of urethane rubber). The coat thinning amount is expressed by a decrease in thickness (μm) of the surface layer of the photosensitive drum 3, and the hardness of the cleaning blade is expressed by results (numerical value) of measurement according to the rubber hardness measuring method complying with JIS K6253-93. And FIG. 5 shows five sets of sample data measured with different conditions of hardness of the cleaning blade.

As shown in FIG. 5, the value of hardness of the cleaning blade becomes greater (harder) when the ambient conditions of the photosensitive drum 3 (may also be called ambient conditions of the cleaning blade) are conditions of 5° C. temperature and 20% humidity (hereinafter, LL conditions) than when the ambient conditions are conditions of 20° C. temperature and 60% humidity (hereinafter, NN conditions). As a result, the amount of coat thinning of the photosensitive drum 3 when the ambient conditions of the photosensitive drum 3 are the LL conditions is 1.1 times to 1.50 times as large as the amount of coat thinning when the ambient conditions are the NN conditions.

This indicates that it is effective for ensuring appropriate image quality to make adjustment so that in the image forming apparatus A, the voltage changing pace ΔEy when the ambience mode is the LL ambience mode will be within the range of roughly 1.1 times to 1.5 times as great as the voltage changing pace ΔEy when the ambience mode is the other ambience mode. Consequently, when the charging applied voltage Ey is set according to the equation (1), it is appropriate to so arrange that the number of sheets correction coefficient kp when the ambience mode is the LL ambience mode will be within the range of roughly 1.1 times to 1.5 times as great as the number of sheets correction coefficient kp when the ambience mode is the other ambience mode.

The image forming apparatus A described above corrects and records the actual cumulative number of printed sheets Pi based on the image forming mode (output mode and ambience mode) selected at the time of each image forming and calculates the adjustment volume (ko×Pia) of the charging applied voltage Ey based on the corrected cumulative number of printed sheets Pia.

However, other methods are conceivable as the method of adjusting the changing pace ΔEy of the charging applied voltage Ey according to the increase in the number of printed sheets, based on the image forming mode.

For example, it is conceivable that, by adding up a predetermined addition-purpose voltage value corresponding to the image forming mode selected at the time of each image forming when the image forming is executed, a correction voltage (correction voltage to the reference applied voltage E0) that is a voltage equivalent to (ko×Pia) in the equation (1) is calculated by the control unit 105 and stored in the data storage unit 103, and the charging applied voltage is corrected (adjusted) based on the correction voltage (correcting by adding to the reference applied voltage E0).

By such configuration as well, the same operation effect as that of the embodiment described above can be obtained.

The present invention is applicable to an image forming apparatus.

As described above, the present invention enables setting the appropriate charging applied voltage (applied voltage to the charging unit) corresponding to the degree of coat thinning of the image bearing body even if there is a change in factors other than the number of printed sheets that affect the degree of coat thinning of the image bearing body while the image forming apparatus is in operation and, as a result, securing the appropriate image density irrespective of a change of state of coat thinning of the image bearing body.

It is more preferable to calculate and record in the memory unit the corrected cumulative number of times of execution of image forming by correcting the actual cumulative number of times of execution of image forming based on the image forming mode selected at each image forming and to calculate the volume of adjustment of the applied voltage to the charging unit based on thus recorded information. This will eliminate the necessity of memorizing (recording) the actual cumulative number of times of execution of image forming for each of the image forming modes. Namely, the appropriate charging applied voltage corresponding to the degree of coat thinning of the image bearing body can be set by a simple processing of always memorizing only the latest corrected cumulative number of times of execution of the image forming.

The invention claimed is:

1. A charging applied voltage control apparatus that is provided in an image forming apparatus that forms an image by transferring an image formed on an image bearing body to a transferring material according to operating conditions corresponding to an image forming mode selected out of a predetermined plurality of candidates and controls a charging applied voltage to a charging unit that charges the image bearing body, the charging applied voltage control apparatus comprising:

a charging applied voltage adjusting circuit unit of changing the charging applied voltage to the charging unit according to an increase in a cumulative number of times of execution of image forming and at a same time adjusting a pace of the change thereof based on the image forming mode.

2. The charging applied voltage control apparatus as defined in claim 1, wherein the image forming mode comprises one or more of a monochrome image forming mode of forming a monochrome image and a color image forming mode of forming a color image by rotating the image bearing body slower than when the monochrome image forming mode is selected; and a first ambience mode to be selected when a temperature and a humidity of an ambience in which the image bearing body is installed are less than a predetermined level and a second ambience mode to be selected in other cases.

3. The charging applied voltage control apparatus as defined in claim 2, wherein the charging applied voltage adjusting circuit unit adjusts the pace of changing the charging applied voltage to the charging unit according to the increase in the cumulative number of times of execution of image forming so that the changing pace when the image forming mode is the color image forming mode will be within a range of about 1.05 times to about 1.6 times as great as the changing pace when the image forming mode is the monochrome image forming mode.

4. The charging applied voltage control apparatus as defined in claim 2, wherein the charging applied voltage adjusting circuit unit adjusts the pace of changing the charging applied voltage to the charging unit according to the increase in the cumulative number of times of execution of image forming so that the changing pace when the image forming mode is the first ambience mode will be within a range of about 1.1 times to about 1.5 times as great as the changing pace when the image forming mode is the second ambience mode.

5. The charging applied voltage control apparatus as defined in claim 1, wherein the charging applied voltage adjusting circuit unit comprises:

an execution times calculating and recording unit of calculating and recording in a storage unit a corrected cumulative number of times of image forming by correcting a cumulative number of times of execution of image forming based on the image forming mode selected at the time of each image forming; and an applied voltage adjustment volume calculating unit of calculating an adjustment volume of the charging applied voltage to the charging unit based on the corrected cumulative number of times of image forming recorded by the execution times calculating and recording unit.

6. The charging applied voltage control apparatus as defined in claim 5, wherein the execution times calculating unit calculates the corrected cumulative number of times of image forming by correcting an actual number of times of execution of image forming according to the image forming mode selected in each image forming when the image forming is executed and adding up a corrected number of times of execution.

7. An image forming apparatus that forms an image by transferring an image formed on an image bearing body to a transferring material according to operating conditions corresponding to an image forming mode selected out of a predetermined plurality of candidates, the image forming apparatus comprising:

a charging applied voltage control apparatus that controls a charging applied voltage to a charging unit that charges the image bearing body, wherein the charging applied voltage control apparatus comprises a charging applied voltage adjusting circuit unit of changing the charging applied voltage to the charging unit according to an increase in a cumulative number of times of execution of image forming and adjusting a pace of the changing the charging applied voltage to the charging unit according to the increase in the cumulative number of times of execution of image forming thereof based on the image forming mode.

8. The image forming apparatus according to claim 7, wherein the image forming mode comprises one or more of a monochrome image forming mode of forming a monochrome image and a color image forming mode of forming a color image by rotating the image bearing body slower than when the monochrome image forming mode is selected; and a first ambience mode to be selected when a temperature and a humidity of an ambience in which the image bearing body is installed are less than a predetermined level and a second ambience mode to be selected in other cases.

9. The image forming apparatus according to claim 7, wherein the charging applied voltage adjusting circuit unit comprises:

an execution times calculating and recording unit of calculating and recording in a storage unit a corrected cumulative number of times of image forming by correcting a cumulative number of times of execution of image forming based on the image forming mode selected at the time of each image forming; and an applied voltage adjustment volume calculating unit of calculating an adjustment volume of the charging applied voltage to the charging unit based on the corrected cumulative number of times of image forming recorded by the execution times calculating and recording unit.

10. A method of forming an image by transferring an image formed on an image bearing body to a transferring material according to operating conditions corresponding to an image forming mode selected out of a predetermined plurality of candidates, the method comprises:

controlling a charging applied voltage to a charging unit that charges the image bearing body;

changing the charging applied voltage to the charging unit according to an increase in a cumulative number of times of execution of image forming; and adjusting a pace of the changing the charging applied voltage to the charging unit according to the increase in the cumulative number of times of execution of image forming thereof based on the image forming mode.

11. The method according to claim 10, wherein the image forming mode comprises one or more of a monochrome image forming mode of forming a monochrome image and a color image forming mode of forming a color image by rotating the image bearing body slower than when the monochrome image forming mode is selected; and a first ambience mode to be selected when a temperature and a humidity of an ambience in which the image bearing body is installed are less than a predetermined level and a second ambience mode to be selected in other cases.

12. The method according to claim 11, wherein adjusting the pace of changing the charging applied voltage to the charging unit according to the increase in the cumulative number of times of execution of image forming so that the changing pace when the image forming mode is the color image forming mode will be within a range of about 1.05 times to about 1.6 times as great as the changing pace when the image forming mode is the monochrome image forming mode.

13. The method according to claim 11, wherein adjusting the pace of changing the charging applied voltage to the charging unit according to the increase in the cumulative number of times of execution of image forming so that the changing pace when the image forming mode is the first ambience mode will be within a range of about 1.1 times to about 1.5 times as great as the changing pace when the image forming mode is the second ambience mode.

14. The method according to claim 10, wherein calculating and recording in a storage unit a corrected cumulative number of times of image forming by correcting a cumulative number of times of execution of image forming based on the image forming mode selected at the time of each image forming; and calculating an adjustment volume of the charging applied voltage to the charging unit based on the corrected cumulative number of times of image forming recorded by an execution times calculating and recording unit.

15. The method according to claim 14, wherein calculating the corrected cumulative number of times of image forming by correcting an actual number of times of execution of image forming according to the image forming mode selected in each image forming when the image forming is executed and adding up a corrected number of times of execution.

16. A computer-readable medium having instructions stored thereon, such that when the instructions are read and executed by a processor, the processor is configured to perform the steps of:

controlling a charging applied voltage to a charging unit that charges an image bearing body;

changing the charging applied voltage to the charging unit according to an increase in a cumulative number of times of execution of image forming; and adjusting a pace of the changing the charging applied voltage to the charging unit according to the increase in the cumulative number of times of execution of image forming thereof based on an image forming mode.

17. The processor according to claim 16, wherein the image forming mode comprises one or more of a monochrome image forming mode of forming a monochrome image and a color image forming mode of forming a color image by rotating the image bearing body slower than when the monochrome image forming mode is selected; and a first ambience mode to be selected when a temperature and a humidity of an ambience in which the image bearing body is installed are less than a predetermined level and a second ambience mode to be selected in other cases.

18. The processor according to 17, wherein adjusting the pace of changing the charging applied voltage to the charging unit according to the increase in the cumulative number of times of execution of image forming so that the changing pace when the image forming mode is the color image forming mode will be within a range of about 1.05 times to about 1.6 times as great as the changing pace when the image forming mode is the monochrome image forming mode.

19. The processor according to 17, wherein adjusting the pace of changing the charging applied voltage to the charging unit according to the increase in the cumulative number of times of execution of image forming so that the changing pace when the image forming mode is the first ambience mode will be within a range of about 1.1 times to about 1.5 times as great as the changing pace when the image forming mode is the second ambience mode.

20. The processor according to 16, wherein calculating and recording in a storage unit a corrected cumulative number of times of image forming by correcting a cumulative number of times of execution of image forming based on the image forming mode selected at the time of each image forming; and calculating an adjustment volume of the charging applied voltage to the charging unit based on the corrected cumulative number of times of image forming recorded by an execution times calculating and recording unit.

21. The processor according to 20, wherein calculating the corrected cumulative number of times of image forming by correcting an actual number of times of execution of image forming according to the image forming mode selected in each image forming when the image forming is executed and adding up a corrected number of times of execution.

* * * * *